US006093058A

United States Patent [19]

Wu

[11] Patent Number: 6,093,058

[45] Date of Patent: Jul. 25, 2000

[54] ELECTRICAL JACK

[75] Inventor: Kun-tsan Wu, Tu-Chen, Taiwan

[73] Assignee: Hon Hai Precision Ind. Co., Ltd., Taipei Hsien, Taiwan

[21] Appl. No.: 09/357,465

[22] Filed: Jul. 20, 1999

[30] Foreign Application Priority Data

Dec. 22, 1998 [TW] Taiwan ..... 87221340

[51] Int. Cl.[7] ..... H01R 13/648

[52] U.S. Cl. ..... 439/607; 439/95; 439/939

[58] Field of Search ..... 439/607, 101, 439/108, 609, 668, 188, 95, 939

[56] References Cited

U.S. PATENT DOCUMENTS

| | | | |
|---|---|---|---|
| D. 420,642 | 2/2000 | Wu | D13/133 |
| 5,207,597 | 5/1993 | Kline et al. | 439/607 |
| 5,278,570 | 1/1994 | Jaramillo et al. | 343/702 |
| 5,338,215 | 8/1994 | Lee et al. | 439/188 |
| 5,766,043 | 6/1998 | Talend | 439/676 |
| 5,954,540 | 9/1999 | Wu | 439/607 |
| 5,984,727 | 11/1999 | Wu et al. | 439/607 |
| 6,000,968 | 12/1999 | Hariwara | 439/607 |
| 6,000,970 | 12/1999 | Wu | 439/669 |

*Primary Examiner*—Gary F. Paumen
*Assistant Examiner*—Truc Nguyen
*Attorney, Agent, or Firm*—Wei Te Chung

[57] ABSTRACT

An electrical jack comprises an insulative rectangular body, an insulative bottom member, a grounding terminal, a number of signal terminals and a shield. A number of passageways is defined in the body for accommodating the terminals. The shield is unitarily formed and has a planar top portion. The shield includes a pair of lateral walls and a pair of rear contact strips for covering lateral surfaces and a rear surface of the body, respectively. A plate extends from a rear edge of the top portion of the shield and is bent to overlap the top portion. A circular opening is defined in a center of the plate for accessing the top portion of the shield for being picked up by a robotic arm. A pair of contact strips forwardly and downwardly extends from a front edge of the plate. A contact arm inwardly extends from a lower edge of one lateral wall for contacting the grounding terminal.

1 Claim, 4 Drawing Sheets

ELECTRICAL JACK

BACKGROUND OF THE INVENTION

The present invention generally relates to an electrical jack, and particularly to an electrical jack having a shield covering the entire outer surface of the jack which can be conveniently picked up and placed by a robotic arm.

An audio jack is commonly mounted on a circuit board to transmit audio signals. A shield is usually attached to outer surfaces of the audio jack for providing protection from EMI (Electromagnetic Interference). Conventional shields cover only upper or lateral surfaces of the audio jack and can not provide overall shielding capabilities. To solve such a problem, metal members comprising two or more pieces are integrated together to cover outer surfaces of the audio jack. However, such a method increases the overall cost of the audio jack and can not ensure the shielding quality at points of integration.

Furthermore, automatic mechanisms are commonly used in the assembly of electronic devices including shields of audio jacks for promoting an efficient use of time and reduction of cost. Thus, the shield is required to have a structure for being conveniently and reliably picked up and placed by a robotic arm.

SUMMARY OF THE INVENTION

Accordingly, the primary purpose of the present invention is to provide an electrical jack having a unitarily formed shield for covering upper, lateral, rear and front surfaces thereof.

The second purpose of the invention is to provide an electrical jack having a shield which can be conveniently picked up and placed by a robotic arm.

The third purpose of the invention is to provide an electrical jack having a shield which can be effectively grounded.

To fulfill the above-mentioned purposes, an electrical jack comprises a rectangular insulative body, an insulative bottom member, a grounding terminal, a plurality of signal terminals and a shield. A plurality of passageways is defined in the body for accommodating the terminals. A tunnel is defined in the front surface of the body in communication with the passageways. The shield is unitarily formed and has a planar top portion. The shield includes a pair of lateral walls and a pair of rear contact strips for covering lateral surfaces and a rear surface of the body, respectively. A plate extends from a rear edge of the top portion of the shield and is bent to overlap the top portion. A circular opening is defined in a center of the plate to expose the top portion of the shield for being picked up by a robotic arm. A pair of contact strips forwardly and downwardly extends from a front edge of the plate for partially covering the front surface of the body and allowing a cylindrical portion of the body to project therebetween. A contact arm inwardly extends from a lower edge of one lateral wall of the shield for contacting the grounding terminal.

DETAILED DESCRIPTION OF THE PREFERRED EMBODIMENT

Figure 1:
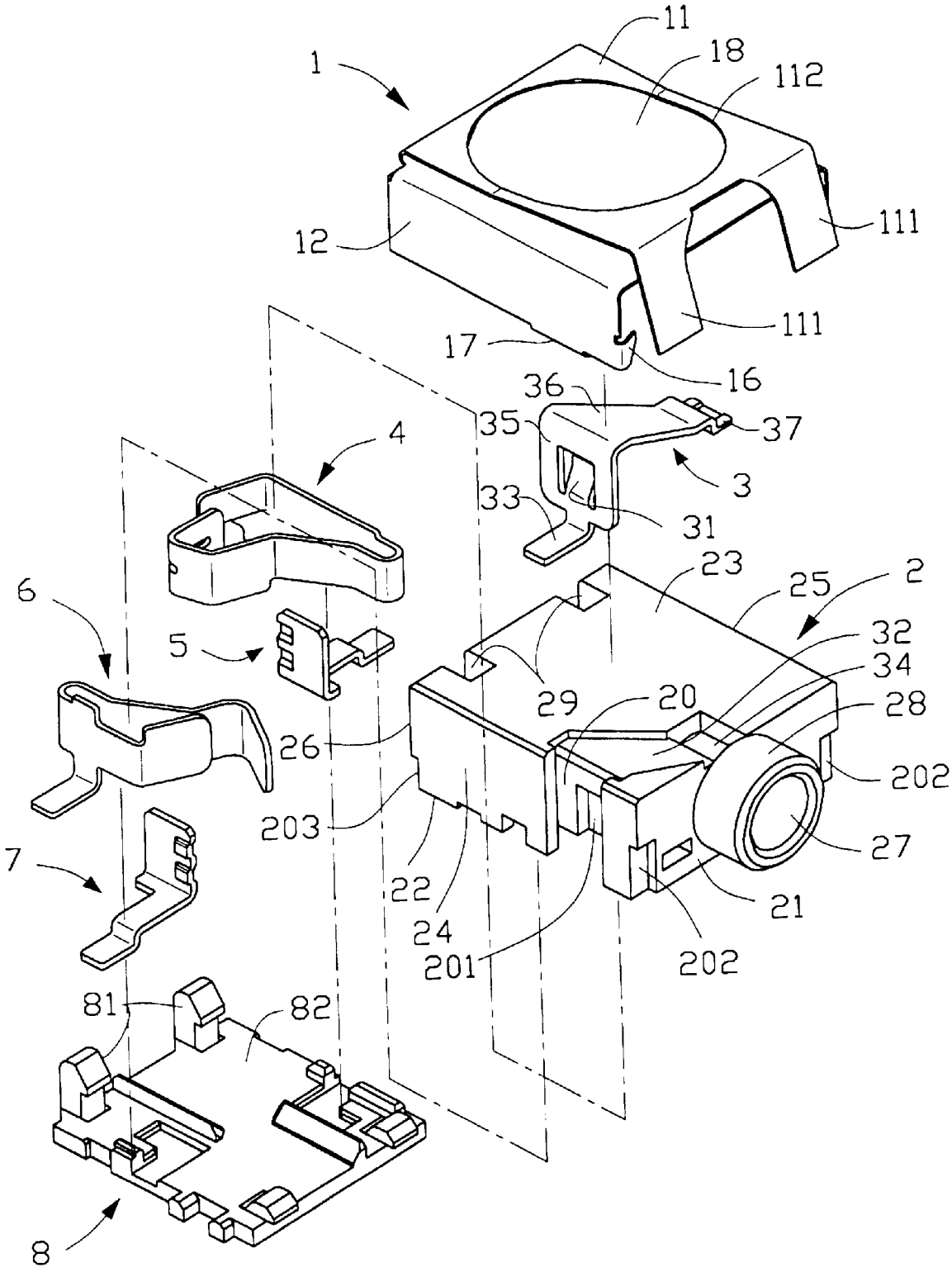
FIG. 1 is an exploded view of an electrical jack in accordance with the present invention.
Figure 2:
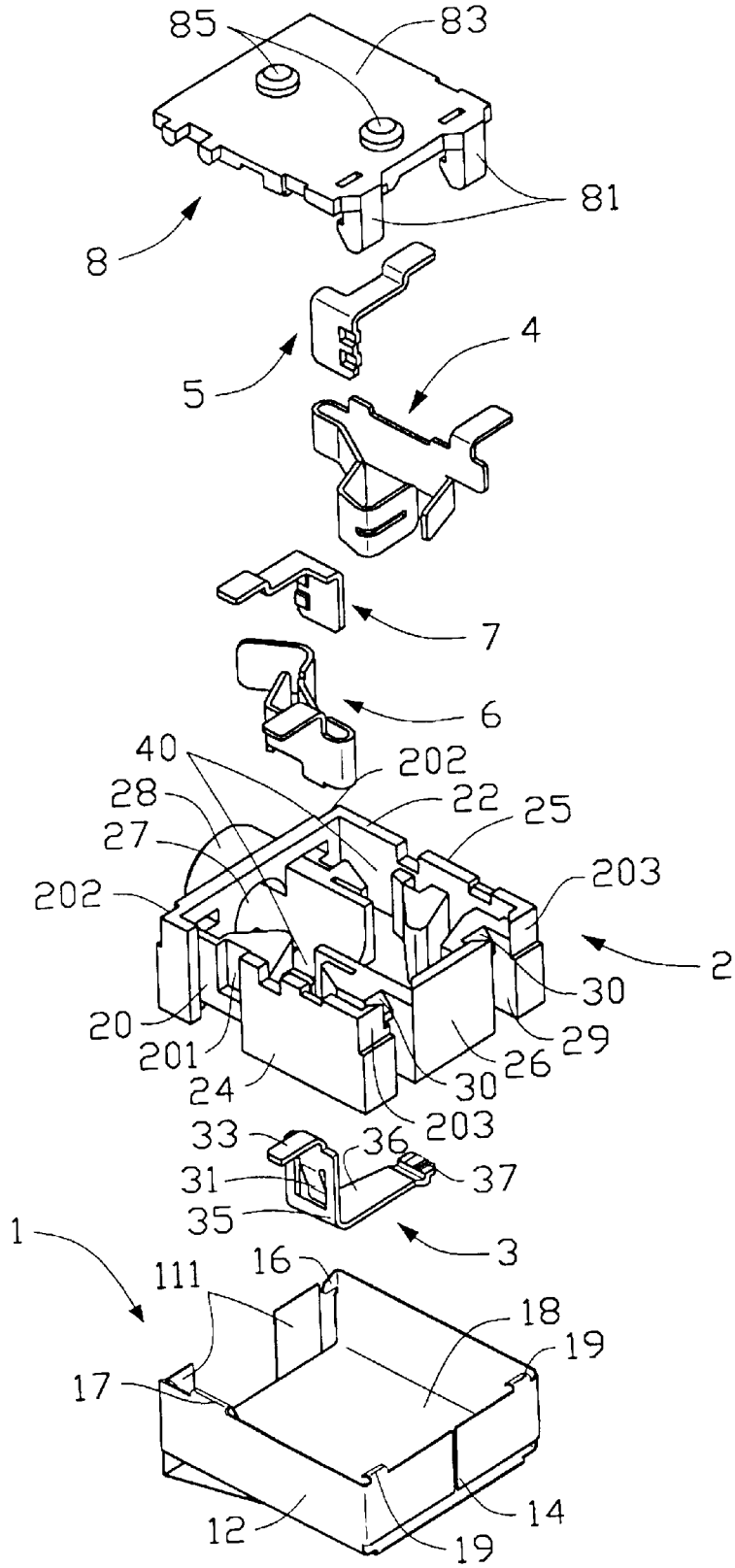
FIG. 2 is similar to FIG. 1 but taken from a different perspective.

Referring to FIGS. 1 and 2, an electrical jack comprises a shield 1, a rectangular insulative body 2, an insulative bottom member 8, a grounding terminal 3 and a plurality of signal terminals 4, 5, 6, 7. A cylindrical portion 28 projects from a front surface 21 of the body 2 and defines a tunnel 27 therethrough for mating with an inserted connector (not shown). A plurality of terminal receiving passageways 40 is defined in the body 2 in communication with the tunnel 27 for accommodating the signal terminals 4, 5, 6, 7. The signal terminals 4, 5, 6, 7 are adapted to engage a corresponding contact of the inserted connector.

A pair of channels 29 is defined in a rear surface 26 of the body 2 between upper and lower surfaces 23, 22 thereof. A projection 30 extends from an inner surface of each channel 29. A first fixing groove 20 is defined in a right lateral face 24 of the body 2 between the upper and lower surfaces 23, 22 thereof. A notch 201 is defined in an inner surface of the first groove 20 and is exposed to the lower surface 22 of the body 2. A second fixing groove 32 is defined in the upper surface 23 of the body 2 and extends from the first groove 20. A rectangular opening 34 is defined in the upper surface 23 of the body and communicates with the tunnel 27. The first and second grooves 20, 32 are adapted to receive the grounding terminal 3.

The grounding terminal 3 includes a center portion 35, a contact portion 36 inwardly extending from one edge thereof and a tail 33 outwardly extending from an opposite edge thereof. A lance 31 is inwardly stamped from the center portion 35. A stepped portion 37 extends from a distal end of the contact portion 36. When the grounding terminal 3 is attached to the body 2, the center portion 35 is received in the first groove 20 whereby the lance 31 engages the notch 201 of the first groove 20, and the contact portion 36 is received in the second groove 32 whereby the stepped portion 37 extends into the opening 34 of the upper surface 23 for contacting a grounding portion of the inserted connector. The tail 33 of the grounding terminal 3 is arranged to rest on a surface of a circuit board (not shown) and soldered thereto using Surface Mounting Technology.

A pair of first recesses 202 is defined in the front surface 21 of the body 2 at bottom and lateral edges thereof. Similarly, a pair of second recesses 203 is defined in the rear surface 26 of the body 2 at bottom and lateral edges thereof.

A top surface 82 of the bottom member 8 is engaged with the lower surface 22 of the body 2. A pair of standing hooks 81 projects from the bottom member 8 to engage with the projections 30 of the channels 29 of the body 2. A pair of posts 85 projects from a bottom face 83 of the bottom member 8 for reception in apertures defined in the circuit board thereby properly positioning the audio jack on the circuit board.

Figure 3:
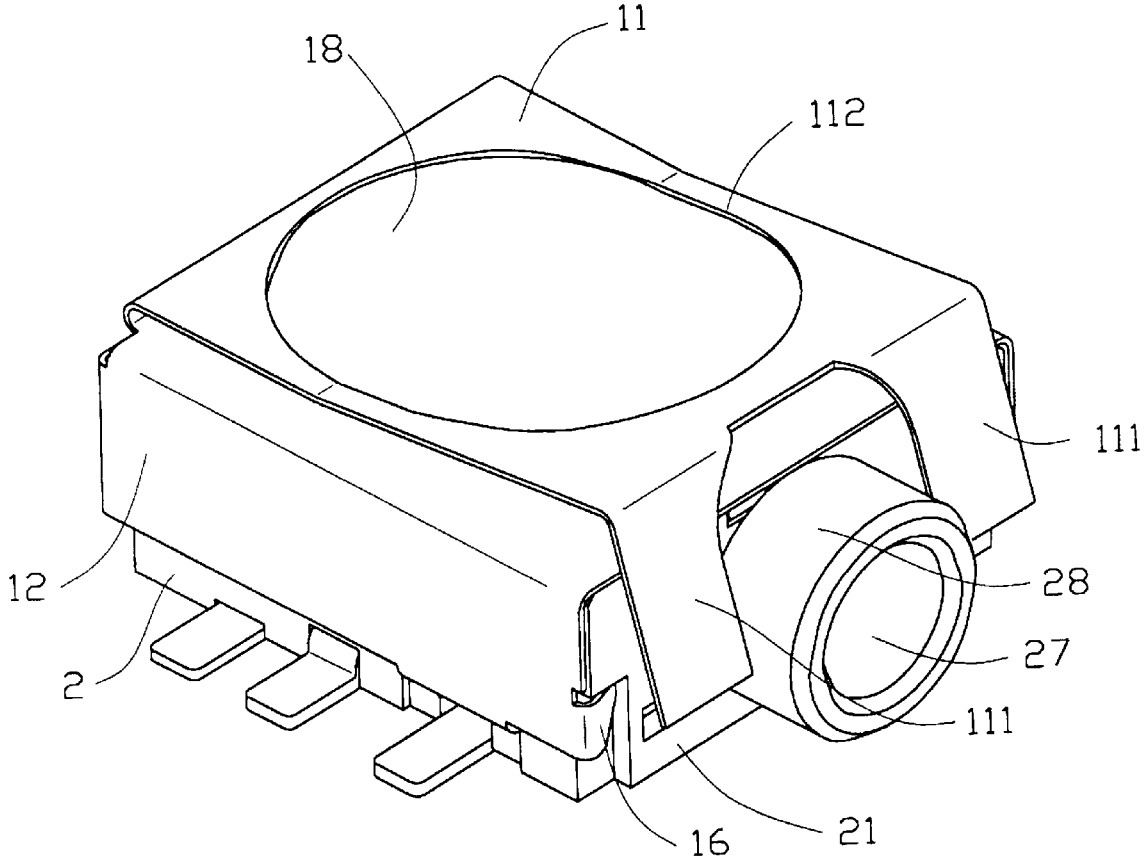
FIG. 3 is an assembled view of FIG. 1.

Also referring to FIG. 3, the signal terminals 4, 5, 6, 7 each have a tail (not labeled) outwardly extending from the body 2 and arranged to rest on the circuit board and be soldered thereto using Surface Mounting Technology.

Figure 4:
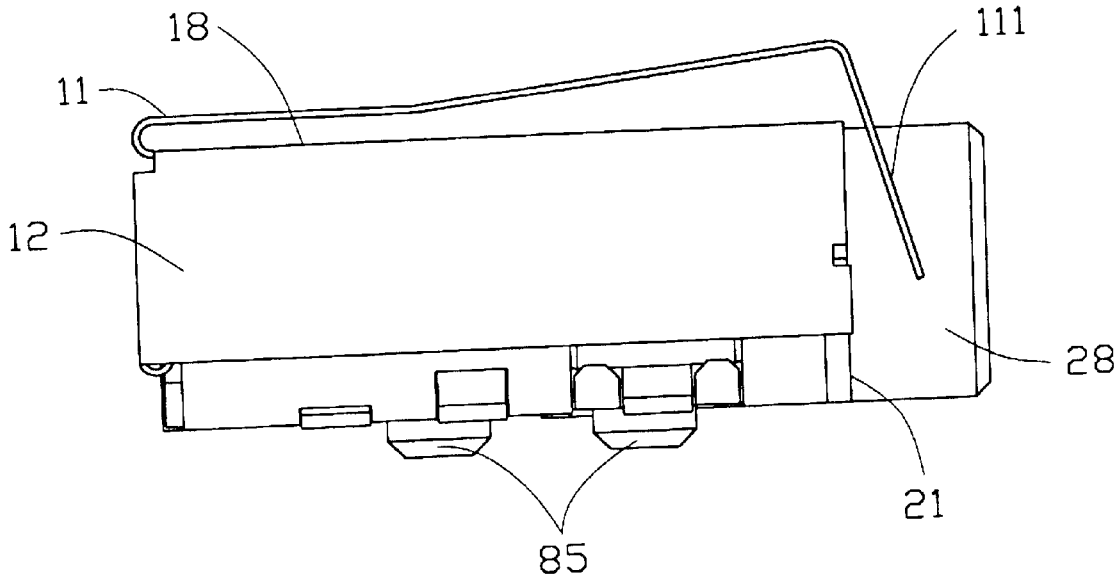
FIG. 4 is a side view of FIG. 3.

Also referring to FIG. 4, the shield 1 is unitarily formed and covers outer surfaces of the body 2. The shield 1 includes a planar top portion 18 and a pair of side walls 12 extending downward from opposite sides of the top portion 18 for shielding the upper surface 23, the right lateral surfaces 24 and a left lateral surface 25 of the body 2, respectively. A tab 16 inwardly projects from a front edge of each side wall 12 for engaging the corresponding first recess 202 of the front surface 21 of the body 2. A rear strip 14 extends from a rear edge of each side wall 12 and is inwardly bent for shielding the rear surface 26 of the body 2. A clasp 19 inwardly projects from a lower edge of each rear strip 14 for engaging the corresponding second recess 203 of the rear surface 26 of the body 2. A plate 11 extends from a rear edge of the top portion 18 and is bent to overlap the top portion 18. A circular opening 112 is defined in a center of the plate 11 to expose the top portion 18. A pair of contact strips 111 forwardly and downwardly extends from a front edge of the plate 11 thereby partially covering the front surface 21 of the body 2 and allowing the cylindrical portion 28 to project therebetween.

When the audio jack is mounted on the circuit board (not shown), the contact strips 111 abut against a metal panel (not shown), such as a side wall of a computer enclosure, for being effectively grounded. A contact arm 17 inwardly extends from a lower edge of the right side wall 12 for engaging with the grounding terminal 3.

In assembly, a robotic arm has a vacuum suction nozzle (not shown) for picking up the shield 1 and attaching the shield 1 to the body 2. The suction nozzle extends through the opening 112 of the plate 11 and fixes to the top portion 18. It is readily apparent that such a shield 1 can be conveniently and reliably picked up and placed by the robotic arm.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical jack mounted on a circuit board for mating with a connector, comprising:

an insulative body having upper, lateral, bottom, front and rear surfaces, the body defining a plurality of terminal receiving passageways, a tunnel defined in the front surface in communication with the passageways, a groove defined in a lateral surface and an opening defined in the upper surface in communication with the tunnel;

a bottom member adapted to be integrated with the body;

a plurality of terminals received in the passageways for engaging with corresponding contacts of an inserted connector;

a grounding terminal received in the groove of the body and having a portion extending through the opening of the body into the tunnel for contacting a grounding portion of the inserted connector;

a shield adapted to cover the upper, lateral, front and rear surfaces and having a planar top portion and a plate extending from an edge of the top portion and bent to oppose the top portion, the plate defining an opening to expose the top portion;

the plate of the shield extending from a rear edge of the top portion;

the shield being unitarily stamped and including a pair of lateral walls downwardly extending from opposite edges of the top portion, a rear strip inwardly extending from a rear edge of each lateral wall and a pair of contact strips downwardly extending from a front edge of the plate for covering the lateral, rear and front surfaces of the body, respectively;

a contact arm inwardly extending from a bottom edge of the lateral wall of the shield for contacting the grounding terminal;

a tab inwardly projecting from a front edge of at least one lateral wall of the shield;

the body defining at least one first recess in the front surface for securing the tab of the lateral wall therein;

a clasp inwardly projecting from a bottom edge of the rear strip of the shield;

the body defining at least one second recess in the rear surface for securing the clasp of the rear strip of the shield;

a notch being defined in the groove of the body and the grounding terminal including a center portion having an inwardly stamped lance for engaging the notch of the groove of the body; and the body defining at least one channel in the rear surface and at least one hook projecting from the bottom member for engaging in the channel of the rear surface of the body.

* * * * *